US006604648B2

(12) United States Patent
Immerman et al.

(10) Patent No.: US 6,604,648 B2
(45) Date of Patent: Aug. 12, 2003

(54) ATTACHING SYSTEM FOR A CONTAINER AND A BASE

(75) Inventors: Robert A. Immerman, Shaker Heights, OH (US); Russell Benton Snell, Bentleyville, OH (US)

(73) Assignee: InterDesign, Inc., Solon, OH (US)

( * ) Notice: Subject to any disclaimer, the term of this patent is extended or adjusted under 35 U.S.C. 154(b) by 37 days.

(21) Appl. No.: 09/811,972

(22) Filed: Mar. 19, 2001

(65) Prior Publication Data

US 2002/0130133 A1 Sep. 19, 2002

(51) Int. Cl.[7] ..... B65D 23/00
(52) U.S. Cl. ..... 220/630; 220/636; 220/729
(58) Field of Search ..... 220/630, 636, 220/729

(56) References Cited

U.S. PATENT DOCUMENTS

| | | | | | |
|---|---|---|---|---|---|
| 170,946 | A | | 12/1875 | French | |
| 1,798,535 | A | * | 3/1931 | Hill | 220/630 X |
| 1,891,048 | A | | 12/1932 | Keefe | |
| 1,989,329 | A | | 1/1935 | McDonald | |
| 2,057,972 | A | * | 10/1936 | Pieck | 220/630 X |
| 2,158,230 | A | | 5/1939 | Godfrey | |
| 2,171,919 | A | * | 9/1939 | Dodge | 220/630 |
| 2,504,031 | A | * | 4/1950 | Manning | 220/630 X |
| 2,816,685 | A | * | 12/1957 | Schaeffer | 220/630 X |
| 3,107,028 | A | * | 10/1963 | De Robertis | 220/630 X |
| 3,122,257 | A | | 2/1964 | Soehrman | |
| 3,142,934 | A | | 8/1964 | Mehling | |
| 3,526,335 | A | * | 9/1970 | Swett et al. | 220/630 |
| 3,685,685 | A | | 8/1972 | Phillips | |
| 4,224,764 | A | * | 9/1980 | Dziewulski et al. | 220/630 X |
| 4,356,926 | A | | 11/1982 | Priestly et al. | |
| 4,573,604 | A | * | 3/1986 | Guim | 220/630 X |
| 4,887,731 | A | * | 12/1989 | Pett et al. | 220/630 X |

* cited by examiner

*Primary Examiner*—Steven Pollard
(74) *Attorney, Agent, or Firm*—D. Peter Hochberg; Katherine R. Vieyra; Sean Mellino

(57) ABSTRACT

An attachment system for attaching a container and a base, the container having an elongated member extending towards the base and the base having an elongated portion for cooperating with the member to connect the container and base together. The base has other structure for supporting the container.

12 Claims, 8 Drawing Sheets

ATTACHING SYSTEM FOR A CONTAINER AND A BASE

BACKGROUND OF THE INVENTION

1. Field of the Invention

This invention relates to an attachment system for attaching a container and a base, and it more particularly relates to an attachment system for attaching a plastic container to a heavy base made from metal or other material.

2. Description of the Prior Art

Plastic containers for holding a variety of things are well known in the art and widely used. Such containers could be drinking goblets, food holders, dispensing containers for dispensing such items as liquid soap, tooth paste, flowable hygienic products, food products such as mustard and ketchup, bathroom accessories such as tooth brushes and razors, paper baskets and the like. One problem with many of these plastic containers is that they are unstable either when they are empty, partially filled or completely filled. There are various means known in the art for incorporating a stable base for use with such containers. In U.S. Pat. No. 170,946 a jug, jar or pitcher made of glass, earthenware or other material has a saucer in which it is threaded. In U.S. Pat. No. 3,122,257, a hollow vessel such as a drinking glass is pivotally supported on a base for preventing the tipping of the vessel. In this case the vessel is removable from the base. A different base is shown in U.S. Pat. No. 2,158,230, wherein means are provided for collecting condensate from the glass in the base. In each of the foregoing examples, the attachment system is complicated to manufacture, particularly in an efficient and practical manner, and the appearance is generally not aesthetic.

SUMMARY OF THE INVENTION

It is an object of the present invention to provide an attachment system for a container and a base.

Another object of the present invention is to provide an attachment system for a plastic container and a metal base.

Still another object of the present invention is to provide a container with a relatively heavy, stable base, and attachment means for quickly and securely attaching the container and base together.

Another object of the present invention is to provide an attachment system for a plastic container and a metal base having support surfaces for contacting the ground, support surfaces for holding the container on the base and relatively unnoticeable apparatus for connecting the base and the container together by means of a connection through a screw, rivet, adhesives or press fit.

It is still another object of the present invention to provide an attachment system for a container of one material and a base of a heavier material, which system is inexpensive to manufacture, easy and economical to produce and attractive in appearance.

Other objects will be apparent from the description to follow and from the appended claims.

DESCRIPTION OF THE PREFERRED EMBODIMENTS

The preferred embodiments of the invention described below comprise an attachment system including a plastic container having an elongated member extending from the bottom of the container, and a metal base having walls extending either upwardly or downwardly and an elongated portion extending toward the elongated member of the container for connection to the latter member to attach the container and base together.

Figure 1:
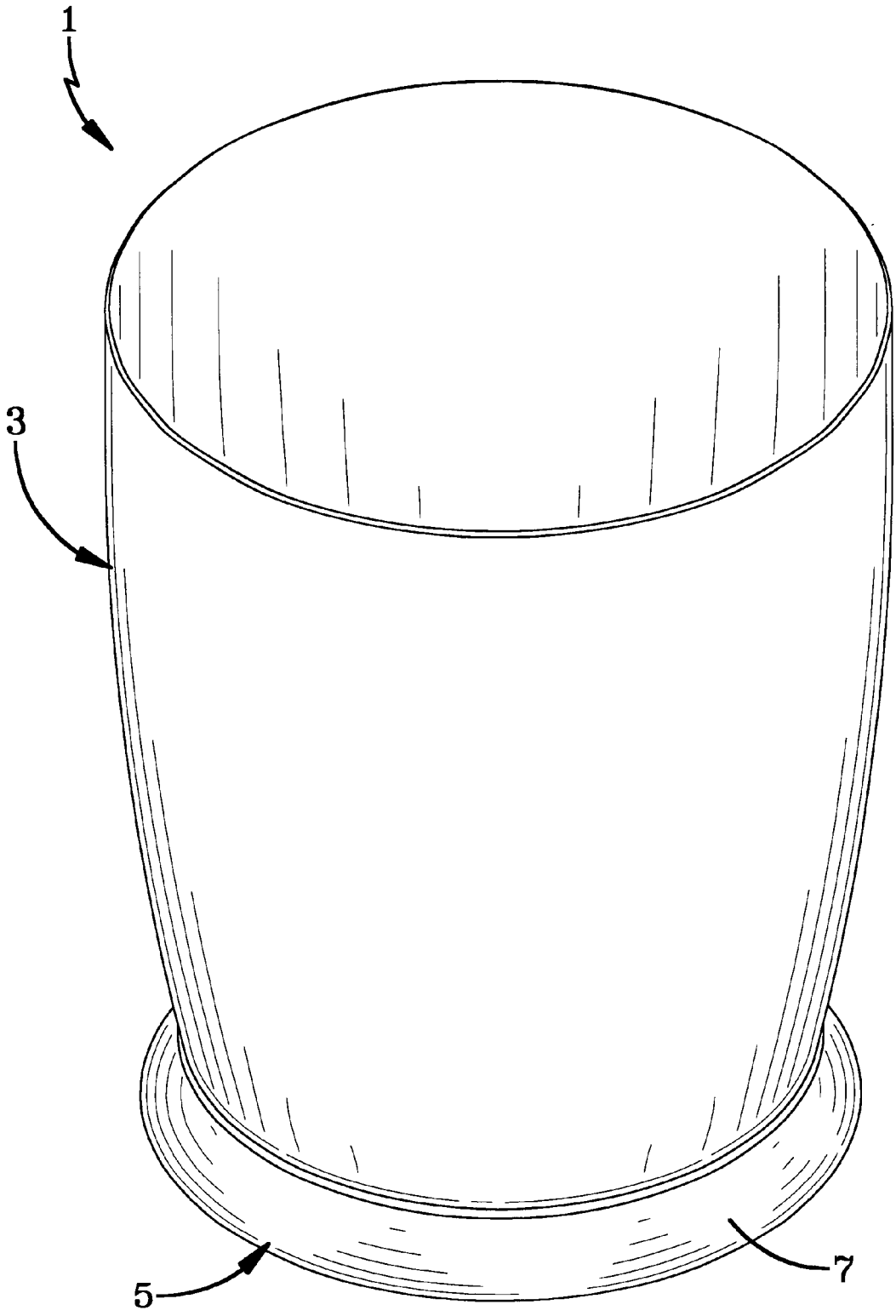
FIG. 1 is a prospective view of a container and base assembly according to the invention.

Referring to FIG. 1, a container and base assembly 1 according to an embodiment of the invention is shown. Assembly 1 includes a container 3 and a base 5. Base 5 has a slightly outwardly bowed wall 7.

Figure 2:
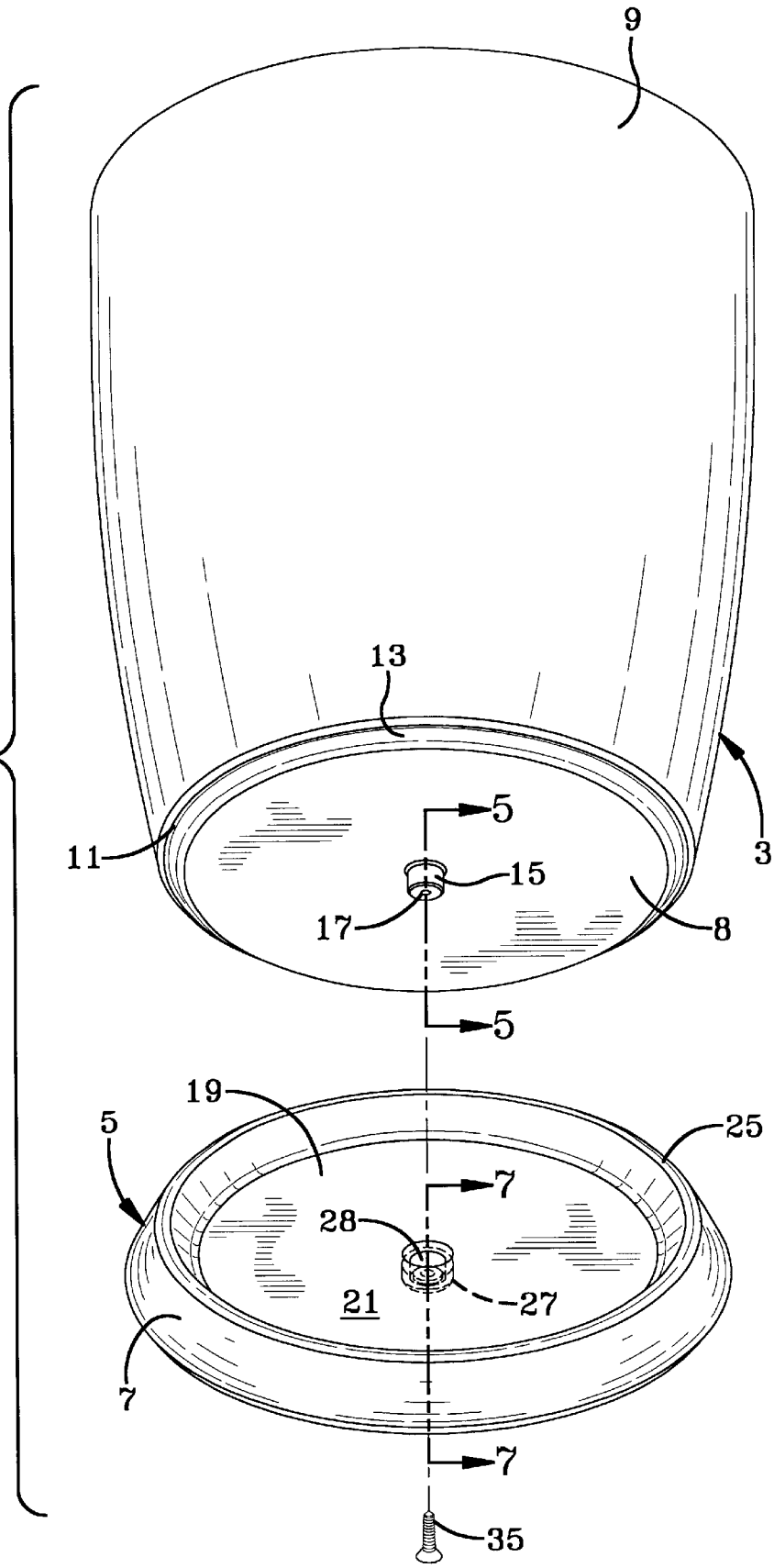
FIG. 2 is an exploded view of the assembly shown in FIG. 1.
Figure 4:
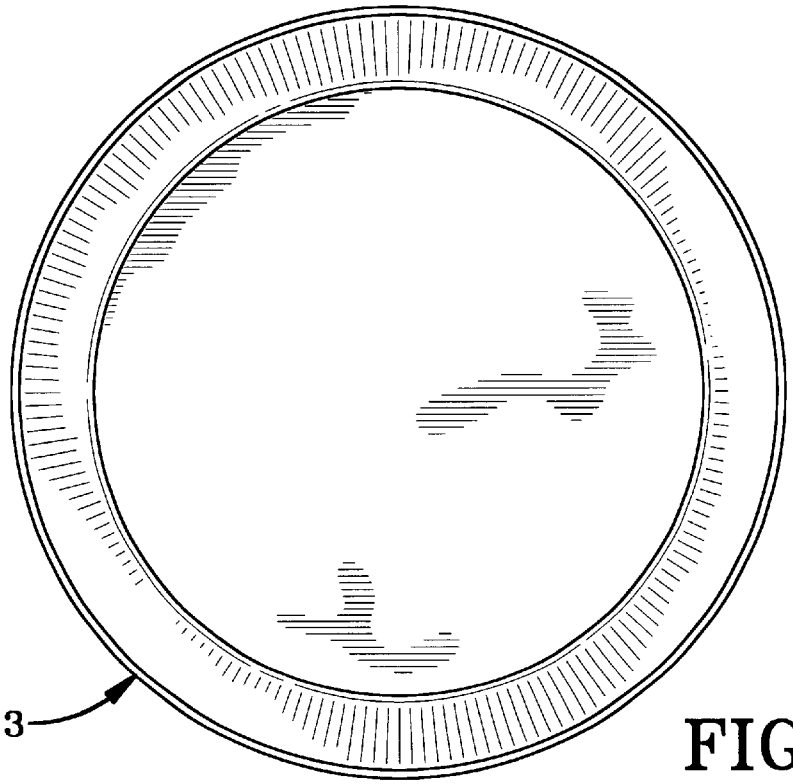
FIG. 4 is a top view of the assembly shown in FIG. 1.

Referring next to FIG. 2, an exploded version of assembly 1 is shown. Container 3 has a round bottom and a slightly bowed wall 9, which together with bottom portion 8 form the container. As shown in the top view in FIG. 4, the container is circular in cross-section, although it could have many other shapes. At the juncture between wall 3 and bottom portion 8 is the supporting structure for the container, having a shoulder 11 which is parallel to bottom portion 8, and an abutment surface 13 which is perpendicular to bottom portion 8. A depending ring 14 extends from bottom portion 8. An elongated member 15 extends from bottom 8 in the opposite direction from wall 9 and preferably is located at the middle of bottom portion 8. Elongated member 15 has a straight bore 17.

Figure 3:
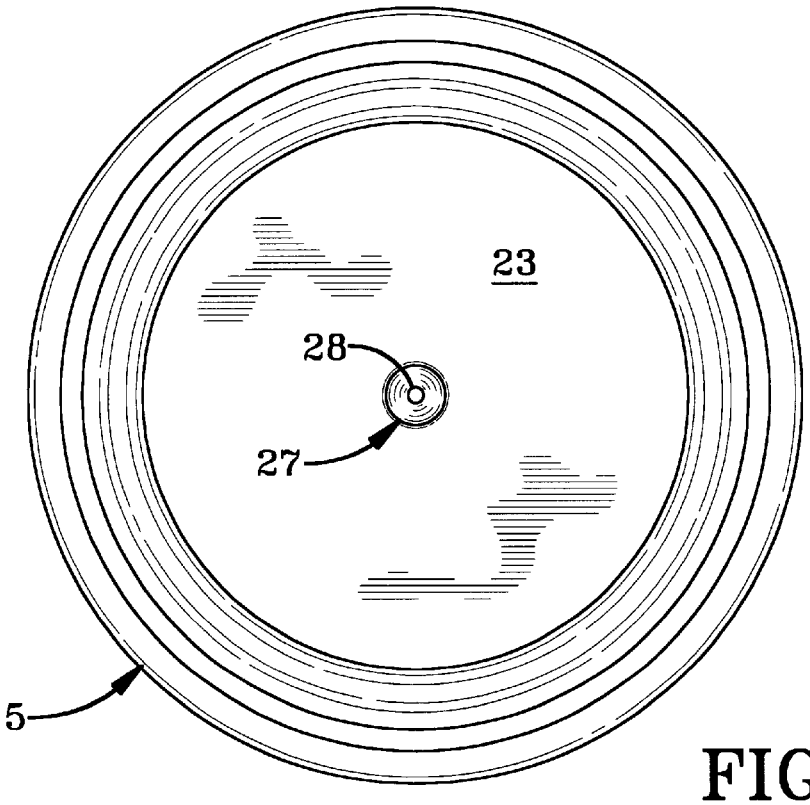
FIG. 3 is a bottom view of the assembly shown in FIG. 1.

Also as shown in FIG. 2 is base 5. Base 5 has a floor portion 19 with an inner face 21 and, with reference to FIG. 3, an outer face 23. Base 5 further has a lip 25 which is configured and dimensioned to engage shoulder 11 and abutment surface 13 of container 3. An elongated portion 27 extends from the outside face of floor portion 19. A bore 28 extends through elongated portion 27 and through floor portion 19. This is shown most clearly in FIG. 7.

Figure 7:
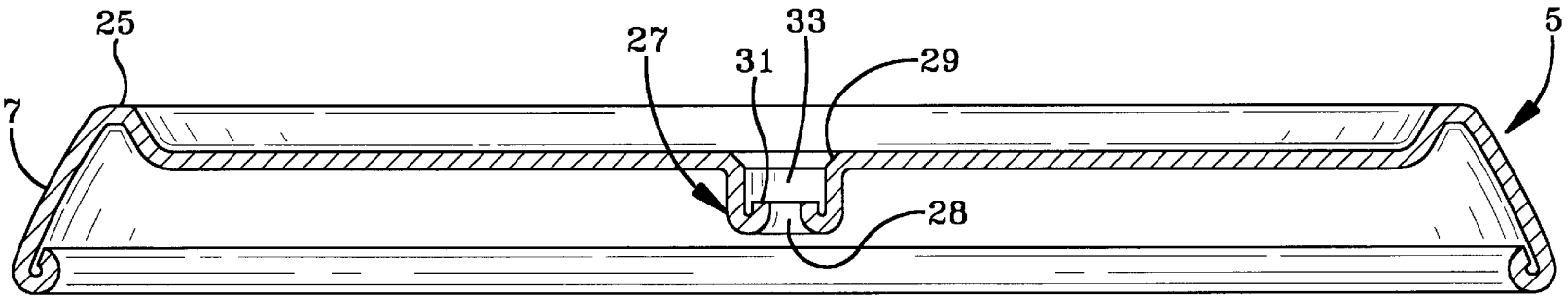
FIG. 7 is a cross-sectional view taken in the direction 7—7 shown in FIG. 2.

FIG. 7 is a cross-section of base 5, and shows floor portion 19, wall 7, lip 25 and elongated portion 27. Elongated portion 27 has bore 28 and further has a countersunk portion 29 around the bore and a shoulder 31 defined by the material forming orifice 31. Portion 27 is thus a tubular portion. The diameter of elongated member 15 and that of bore 17 are such that elongated member 15 can fit into an upper portion 33 of the outer walls of elongated portion 27, and abut against shoulder 31 to limit the amount by which elongated member 15 can enter upper portion 33.

Figure 6:
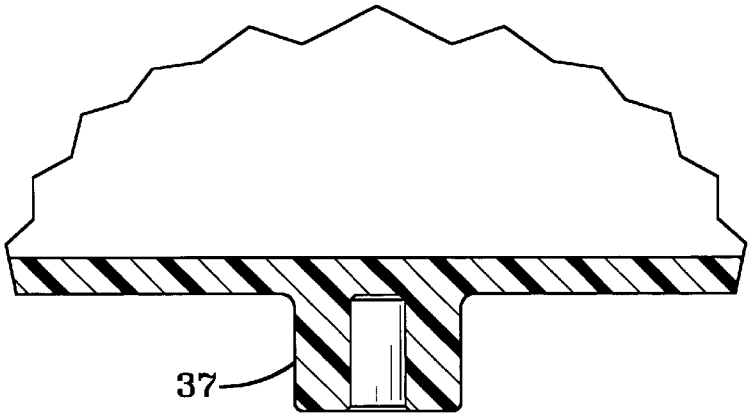
FIG. 6 is another version of the item shown in FIG. 5.

In the embodiment shown in FIG. 2, elongated member 15 is straight having no threads as shown in FIG. 6, and a screw 35 can be inserted through bore 28 and tapped into elongated member 15. The countersunk portion 29 facilitates the entry of elongated member 15 into upper portion 33. The walls forming bore 28 are unthreaded.

Assembly 1 is easy to assemble. One simply puts container 3 on base 5, so that elongated member 15 extends into upper portion 33 and abuts shoulder 31. Lip 25 engages shoulder 11 and abutment surface 13. One simply taps screw 35 into elongated member 15 to firmly hold the base and container together.

Figure 5:
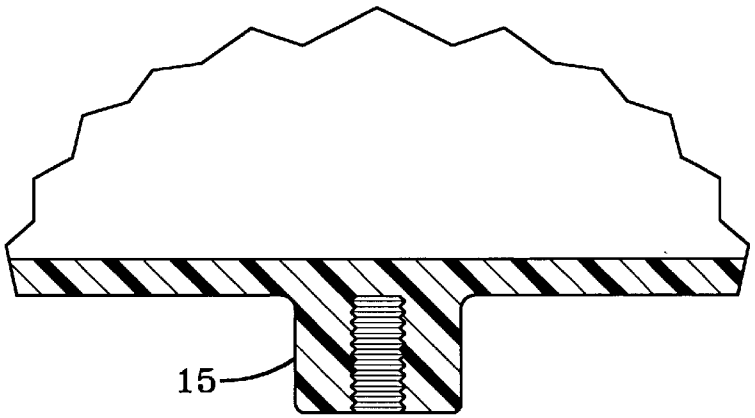
FIG. 5 is a view taken in the direction of arrows 5—5 in FIG. 2.

There are other items which could be used in place of the unthreaded, elongated member 15. Member 15 could be externally threaded and screw 35 could be replaced by an internally threaded hollow dowel to hold container 3 and base 5 together. Elongated member 15 could be internally threaded as shown in FIG. 5 and dimensioned be slid into upper portion 33 and held in place by a screw inserted into threaded hole.

Figure 8:
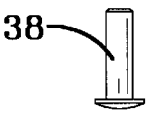
FIG. 8 is an alternate connecting member for use in the assembly according to the invention.
Figure 9A:
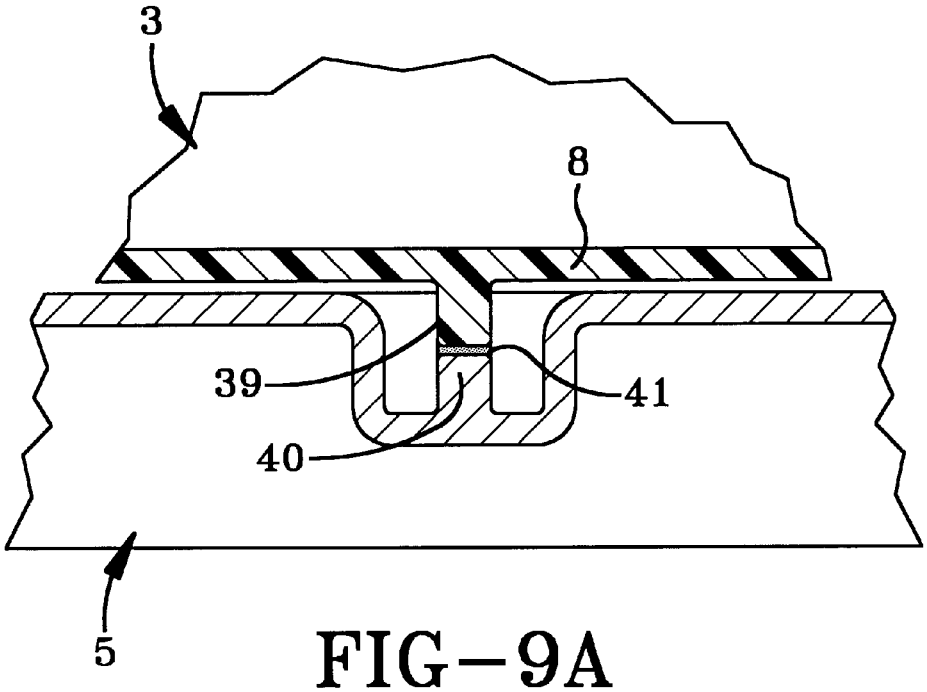
FIG. 9 is another device for connecting the assembly components together.
Figure 9B:
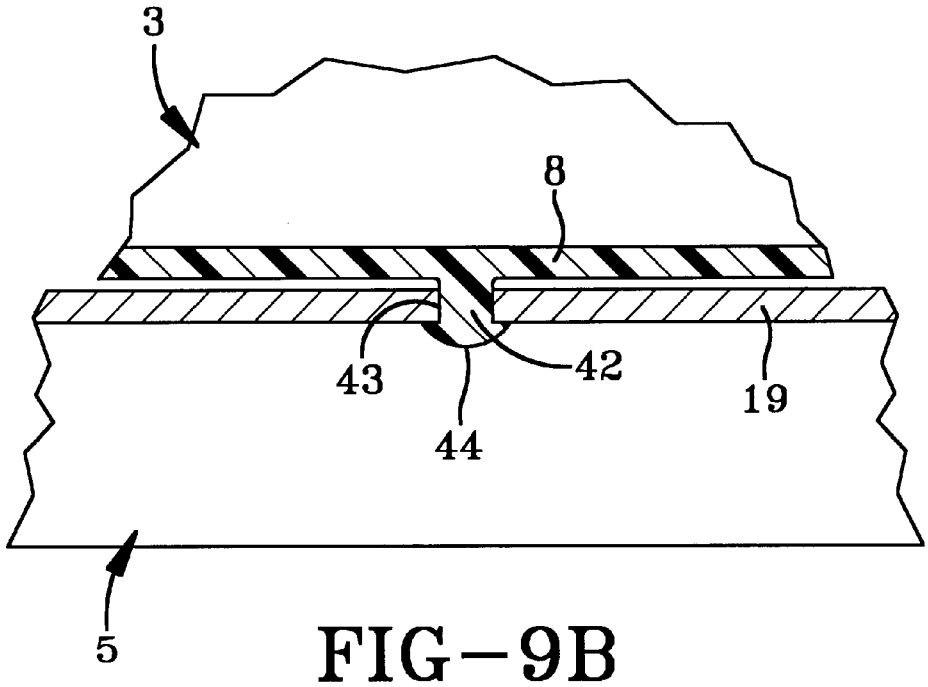

Screw 35 could be replaced by one or more rivets, shown in FIG. 8 as item 38. A connecting member such as screw 35 or rivet 38 could be dispensed with, and a projecting member 39 extending from bottom 8 could meet a projecting portion 40 from base 5 and be secured thereto by an appropriate adhesive as shown in FIG. 9A. Referring to FIG. 9B, a projecting thermoplastic member 42 could extend downwardly from bottom 8 through a hole 43 in floor portion 19, with a heat formed cup 44 on member 42 to hold container 3 and base 5 together. Of course, combinations of screws, rivets and/or adhesives could be employed as well.

Figure 10:
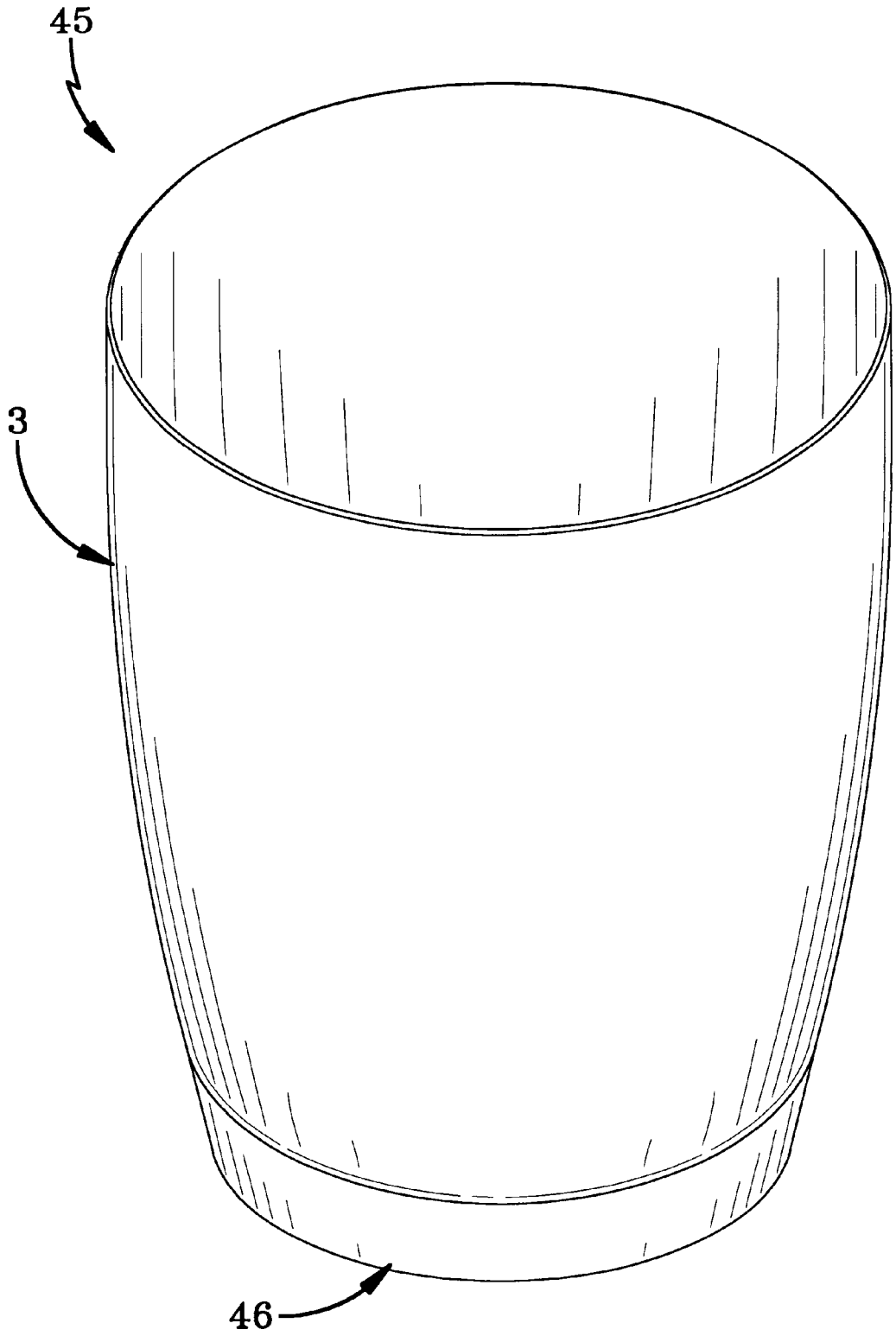
FIG. 10 is a prospective view of another embodiment of the invention.
Figure 11:
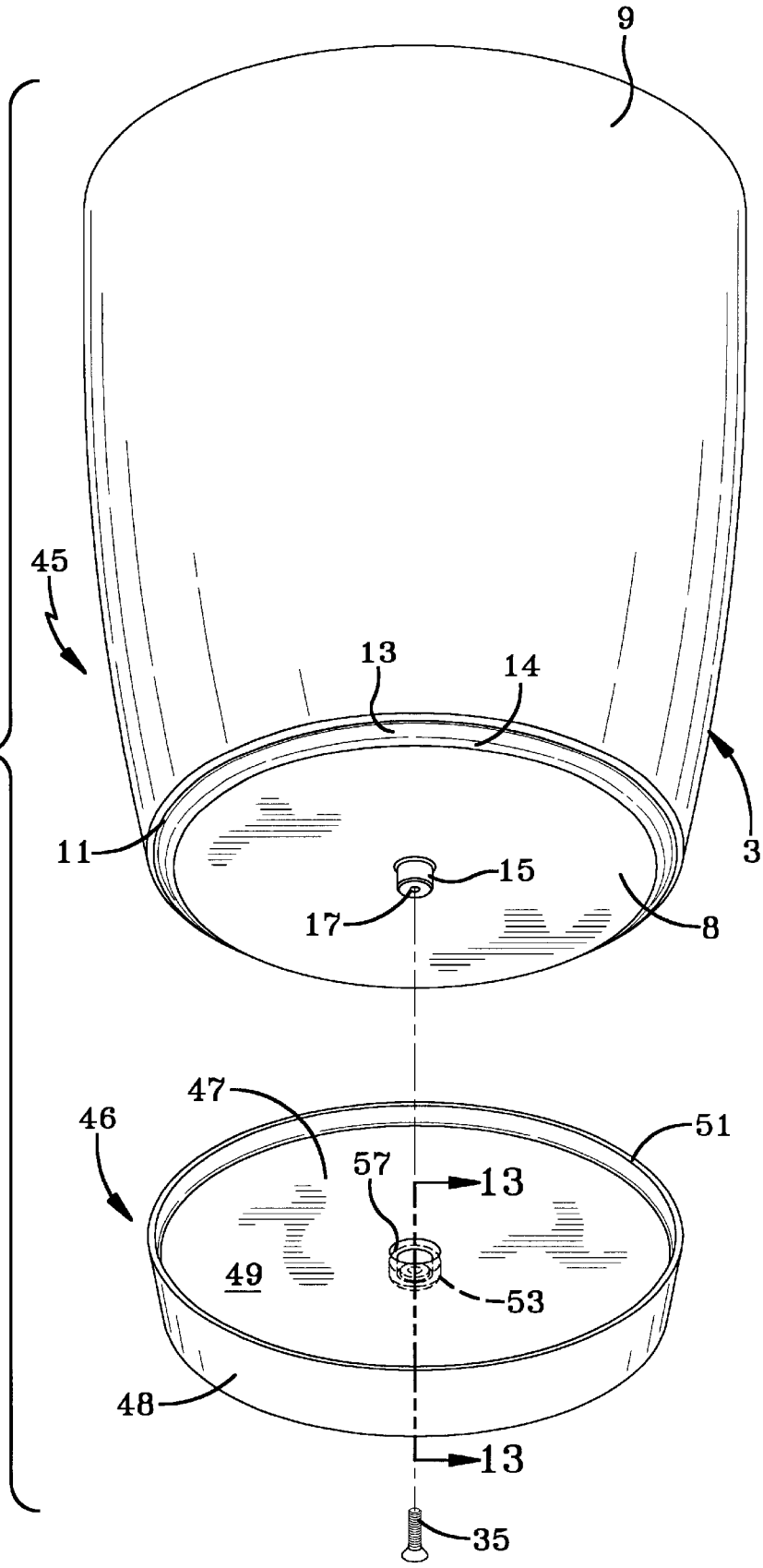
FIG. 11 is an exploded view of the embodiment shown in FIG. 9.
Figure 12:
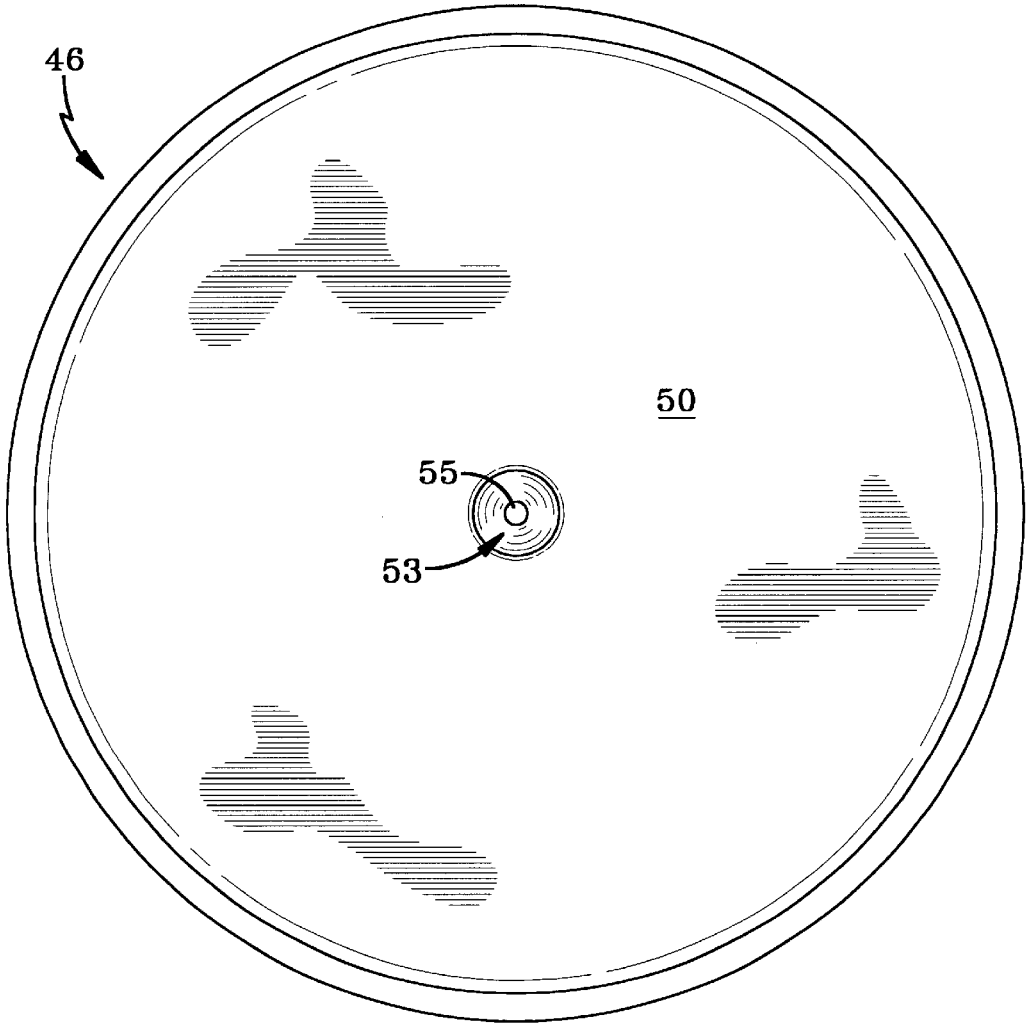
FIG. 12 is a bottom view of the embodiment shown in FIG. 9.
Figure 13:
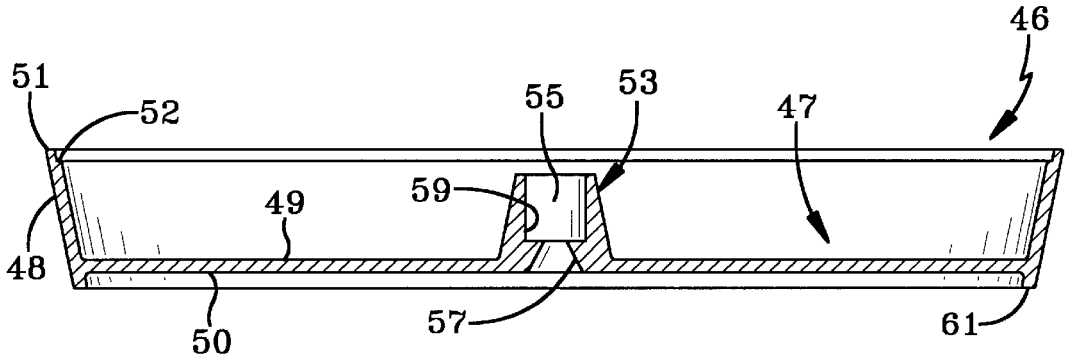
FIG. 13 is taken in the direction of arrows 13—13 in FIG. 1.

Another embodiment of the invention is the container and base assembly 45 shown in FIGS. 10 and 11. Assuming the base described below is the same size as base 5 in the first embodiment of the invention, the same container 3 can be used. Assembly 45 has a base 46 attached to container 3. Since container 3 is the same as in the present embodiment, it has the same identification numerals and its structure will not be discussed. Base 46 has a floor portion 47 from which depend on outwardly bowed wall 48. Floor portion 47 has an inner face 49 and an outer face 50 which can be seen in the bottom view of FIG. 12. Referring to FIG. 13, base 46 has an upwardly extending peripheral lip 51 which engages shoulder 11, and an upwardly facing L-shaped shoulder 52 for engaging ring 14 extending from bottom portion 8 of container 3. An elongated portion 53 extends upwardly from inner face 49, and has a bore 55, which extends through elongated portion 53 and through floor portion 47. Floor portion 47 is countersunk at 57 for guiding self-tapping screw 35 into bore 17. Bore 17 is dimensioned to receive member 15 and has a shoulder 59 in an upper portion 61 of bore 55 for limiting the amount by which elongated member 15 can enter bore 55. Wall 48 has a distal end 61 for engaging the ground. It should be apparent that base 46 has a hollow portion between the outer face of its floor and ground according to the height of wall 48 whereas the hollow portion in the embodiment of FIGS. 2–10 is between the inside face of floor portion 19 and container 3.

The different embodiments for attaching elongated member 15 to base 46 discussed with respect to FIGS. 1–9, would apply as well to the embodiment of FIGS. 10–13.

Bases 5 and 46 have been described as being made of metal. Advantageously, they could be chrome plated to protect the metal and to make them more attractive. The invention would apply to other materials as well, such as glass, ceramic materials, other plastics and the like. The invention could be used on virtually any size container and base assembly.

The invention has been described in detail with particular emphasis being placed on the preferred embodiments thereof, but variations and modifications within the spirit and scope of the invention may occur to those skilled in the art to which the invention pertains.

We claim:

1. An attachment system for attaching a container and a base together, said system comprising:

a container; and a base;

said container including:

a wall extending in one direction for holding something in said container;

at least one supporting surface of a predetermined configuration;

a bottom portion connected to said wall; and an elongated member extending from said bottom portion, said elongated member having structure for cooperating with said base member to connect said container to said base;

said base including:

a floor portion;

a supporting member configured to cooperate with said at least one supporting surface to support said container;

a support for said supporting member extending from said floor portion, said support having a supporting edge for engaging said supporting surface of said container to support said container on said base, wherein said supporting surface of said container is the juncture of said bottom portion and said wall, and said supporting edge is the lip of said wall; said juncture and said lip being configured to engage each other, and wherein one of said juncture and said lip includes a shoulder and an abutment surface for receiving and supporting the other of said juncture and said lip; and an elongated portion extending from said floor portion towards said elongated member when said base and said container are assembled, said elongated portion cooperating with said elongated member in a telescoping manner to attach said container and said base together, wherein said elongated portion of said base has a bore with an internal abutment shoulder facing said container, said bore being configured and dimensioned to receive said elongated member, said elongated member engaging said shoulder to limit the entry of said elongated portion into said bore.

2. An attachment system according to claim 1 and further including a connecting member with an interior wall, and wherein said elongated member has cooperating with the interior wall of said connecting member to attach said container and said base together.

3. An attachment system according to claim 1 wherein said elongated member comprises an internally threaded tube, and wherein said attachment system further includes a connecting member comprising a screw having threads for mating with the threads of said tube for attaching said container and said base together.

4. An attachment system according to claim 3 wherein said elongated portion of said base comprises an internally unthreaded tubular portion dimensioned to receive said connecting member and guide said connecting member into said unthreaded tubular portion.

5. An attachment system according to claim 1 wherein one of said elongated member and said elongated portion fits inside the other of said member and portion, said elongated member and said elongated portion being configured and dimensioned for said member and portion to force fit together to attach said container and said base together.

6. An attachment system according to claim 1 wherein said elongated member and said elongated portion engage each other at engaging surfaces of said member and portion, and further including adhesive on said engaging surfaces for connecting said elongated member and said elongated portion to attach said container and said base together.

7. An attachment system according to claim 1 wherein said elongated member is made from thermoplastic, and wherein said base has a hole for receiving said elongated member, the end of said elongated member being heat deformable to form a cap larger than said hole to attach said containing and screw base together.

8. An attachment system according to claim 1 wherein said elongated portion including a bore, and said system further includes a connecting member for extending through said base for connecting engagement with said elongated member; and wherein said floor portion of said base has an inner face facing said bottom portion of said container and an outer face, and said base is countersunk on said outer face around said bore.

9. An attachment system, according to claim 1 wherein said floor portion of said base has an inner face adjacent said bottom portion of said container and an outside face, and walls extending from said inner face for contacting said elongated member of said container.

10. An attachment system according to claim 1 wherein said floor portion of said base has an inner face facing said bottom portion of said container, an outer face, and a wall extending from said outer face having a distal surface for engaging ground, and wherein said elongated portion extends from said outer face.

11. An attachment system according to claim 10 wherein said inner face is countersunk opposite said elongated member of said base for receiving at least a portion of said elongated member.

12. An attachment system according to claim 11 wherein said inner face of said base has a peripheral lip for engaging said container to stabilize said container on said base.

* * * * *